US010724721B2

(12) United States Patent
Su et al.

(10) Patent No.: US 10,724,721 B2
(45) Date of Patent: Jul. 28, 2020

(54) LIGHT EMITTING DIODE DEVICE

(71) Applicant: InterLight Optotech Corporation, Taoyuan County (TW)

(72) Inventors: Hwa Su, Taoyuan County (TW); Tzu-Chi Cheng, Taoyuan County (TW); Hong-Zhi Liu, Taoyuan County (TW)

(73) Assignee: EPISTAR CORPORATION, Hsinchu (TW)

( * ) Notice: Subject to any disclaimer, the term of this patent is extended or adjusted under 35 U.S.C. 154(b) by 124 days.

(21) Appl. No.: 15/064,256

(22) Filed: Mar. 8, 2016

(65) Prior Publication Data

US 2016/0186933 A1 Jun. 30, 2016

Related U.S. Application Data

(63) Continuation of application No. 13/911,435, filed on Jun. 6, 2013, now Pat. No. 9,310,031.

(51) Int. Cl.

| | |
|---|---|
| ***F21V 23/00*** | (2015.01) |
| ***F21K 9/232*** | (2016.01) |
| ***F21K 9/238*** | (2016.01) |
| *F21Y 115/10* | (2016.01) |
| *F21Y 107/90* | (2016.01) |

(52) U.S. Cl.

CPC ..... *F21V 23/006* (2013.01); *F21K 9/232* (2016.08); *F21K 9/238* (2016.08); *F21Y 2107/90* (2016.08); *F21Y 2115/10* (2016.08)

(58) Field of Classification Search

CPC ..... F21V 23/006; F21K 9/238

See application file for complete search history.

(56) References Cited

U.S. PATENT DOCUMENTS

| | | | | |
|---|---|---|---|---|
| 5,463,280 A | | 10/1995 | Johnson | |
| 5,669,703 A | * | 9/1997 | Wheeler | F21V 19/006 362/249.04 |
| 5,688,042 A | | 11/1997 | Madadi et al. | |
| 5,726,535 A | | 3/1998 | Yan | |
| 5,924,784 A | | 7/1999 | Chliwnyj et al. | |

(Continued)

FOREIGN PATENT DOCUMENTS

| | | |
|---|---|---|
| CN | 201964196 U | 9/2011 |
| CN | 102518960 A | 6/2012 |

(Continued)

*Primary Examiner* — Sharon E Payne

(74) *Attorney, Agent, or Firm* — Muncy, Geissler, Olds & Lowe, P.C.

(57) ABSTRACT

A LED bulb includes a circuit board, a lighting module, an electrical connector, and a lamp shade. The circuit board includes a slot. The lighting module includes a transmissive substrate having a first surface and a second surface opposite to the first surface. The lighting module includes a circuit layer arranged on the first surface, an electrode component arranged on the first surface and electrically connected to the circuit layer, a plurality of LED dies arranged on the first surface and electrically connected to the circuit layer and the electrode component, and the phosphor layer covering the first surface and the second surface. The electrical connector is electrically connected to the circuit board. The lamp shade is associated with the electrical connector.

13 Claims, 5 Drawing Sheets

(56) References Cited

U.S. PATENT DOCUMENTS

| | | | | |
|---|---|---|---|---|
| 6,465,961 | B1 | 10/2002 | Cao | |
| 6,621,222 | B1 * | 9/2003 | Hong | F21V 3/02 315/272 |
| 7,163,324 | B2 | 1/2007 | Pederson | |
| 7,396,142 | B2 * | 7/2008 | Laizure, Jr. | F21V 31/005 313/318.01 |
| 8,143,634 | B2 | 3/2012 | Park et al. | |
| D662,231 | S | 6/2012 | Sakamoto et al. | |
| 8,371,722 | B2 | 2/2013 | Carroll | |
| 8,403,509 | B2 | 3/2013 | Chin et al. | |
| 8,410,726 | B2 | 4/2013 | Dau et al. | |
| 8,545,056 | B2 | 10/2013 | Kajiya et al. | |
| 8,653,723 | B2 | 2/2014 | Cao et al. | |
| 8,801,224 | B2 | 8/2014 | Huang et al. | |
| 8,820,966 | B2 | 9/2014 | Igaki et al. | |
| 2002/0048174 | A1 | 4/2002 | Pederson | |
| 2002/0176253 | A1 | 11/2002 | Lee | |
| 2005/0174769 | A1 | 8/2005 | Yong et al. | |
| 2010/0201269 | A1 * | 8/2010 | Tzou | F21V 23/006 315/51 |
| 2011/0103055 | A1 | 5/2011 | Carroll | |
| 2011/0163681 | A1 | 7/2011 | Dau et al. | |
| 2012/0300430 | A1 * | 11/2012 | Kawashima | H01L 33/504 362/84 |

FOREIGN PATENT DOCUMENTS

| | | | | |
|---|---|---|---|---|
| CN | 102800789 | A | 11/2012 | |
| CN | 202791511 | U | 3/2013 | |
| JP | 5555371 | B2 * | 7/2014 | F21V 23/006 |
| TW | 201221847 | A | 6/2012 | |
| WO | WO 2012/155883 | A1 | 8/2012 | |

* cited by examiner

LIGHT EMITTING DIODE DEVICE

REFERENCE TO RELATED APPLICATION

This application is a continuation application of U.S. patent application, Ser. No. 13/911,435, filed on Jun. 6, 2013, entitled "LIGHT EMITTING DIODE BULB", and the contents of which are incorporated herein by reference.

BACKGROUND

Technical Field

The present invention relates to a light emitting diode bulb, and in particular to a light emitting diode bulb using transmissive substrate for carrying light emitting diode dies.

Description of the Related Art

A light emitting diode (LED) is a kind of semiconductor device, which exploits the property of direct-bandgap semiconductor material to convert electric energy into light energy efficiently and has the advantages of long service time, high stability and low power consumption and is developed to replace the traditional non-directivity light tube and incandescent lamp.

Referred is made to FIG. 1, which is a sectional view of a conventional light emitting diode (LED) bulb. The LED bulb 20 includes a housing 200, a circuit board 210, a plurality of light emitting diodes (LEDs) 226, a lamp shade 226, and a conductive connector 240. The circuit board 210 and conductive connector 240 are respectively disposed on two opposite sides of the housing 200. The circuit board 210 is of plate-shape and a surface with larger area of the circuit board 219 is attached to the housing 200. The LEDs 226 are placed on the surface with larger area of the circuit board 210 and electrically connected to the circuit board 210. The circuit board 210 provides an electric power to the LEDs 226 for lighting the LEDs 226, light emitted from the LEDs 226 transmits towards a direction opposite to the housing 200. The lamp shade 230 is assembled with the housing 220 such that the circuit board 210 and the LEDs 226 are arranged between the housing 200 and the lamp shade 230.

However, the LEDs 226 are light source having characteristic of directivity such that light emitted from the LEDs 226 just can transmit forwards (namely, the light emitted from the LEDs 226 transmits to a direction opposite to the housing 200), such that the illuminant area and lighting demand of the LED bulb 20 cannot compete with incandescent bulb for non-directivity requirement, and then usage desire of user is reduced.

SUMMARY

It is an object to provide a light emitting diode (LED) bulb, the light emitting diode bulb has transmissive substrate for carrying LED dies.

Accordingly, the LED bulb includes a circuit board, a lighting module, an electrical connector, and a lamp shade. The circuit board has at least one slot. The lighting module includes a transmissive substrate, a circuit layer, an electrode component, a plurality of LED dies, and a phosphor layer. The transmissive substrate includes a first surface and a second surface opposite to the first surface. The circuit layer is arranged on the first surface. The electrode component is arranged on the first surface and electrically connected to the circuit layer. The LED dies are arranged on the first surface, and electrically connected to the circuit layer and the electrode component. The phosphor layer covers the first surface and the second surface. The electrical connector is electrically connected to the circuit board. The lamp shade is associated with the electrical connector.

BRIEF DESCRIPTION OF THE DRAWINGS

The features of the invention believed to be novel are set forth with particularity in the appended claims. The invention itself, however, may be best understood by reference to the following detailed description of the invention, which describes an exemplary embodiment of the invention, taken in conjunction with the accompanying drawings, in which:

DESCRIPTION OF THE PREFERRED EMBODIMENTS

A preferred embodiment of the present invention will be described with reference to the drawings.

Figure 1:
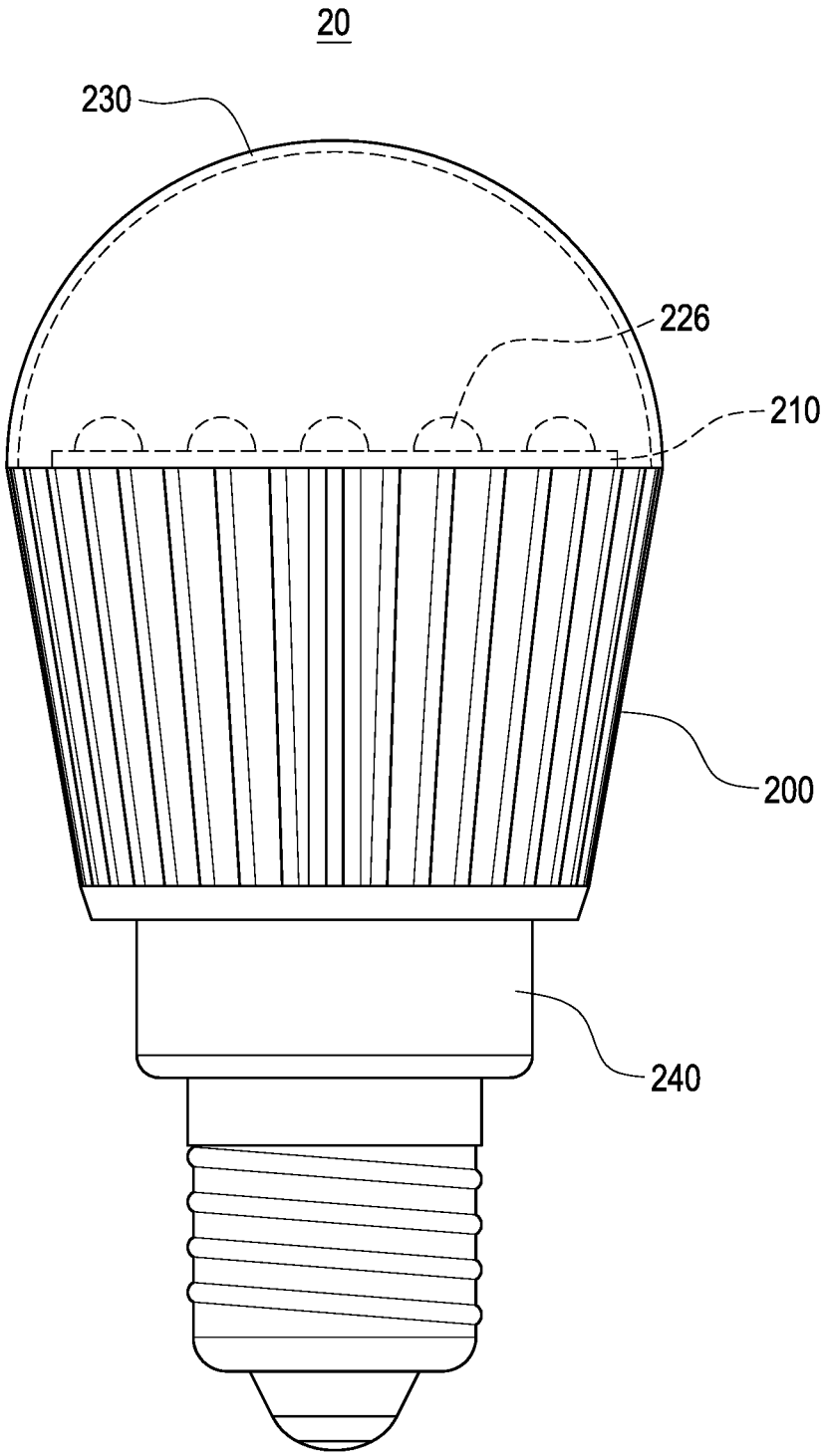
FIG.1 RELATED ART
FIG. 1 is a lateral view of a conventional light emitting diode (LED) bulb.
Figure 2:
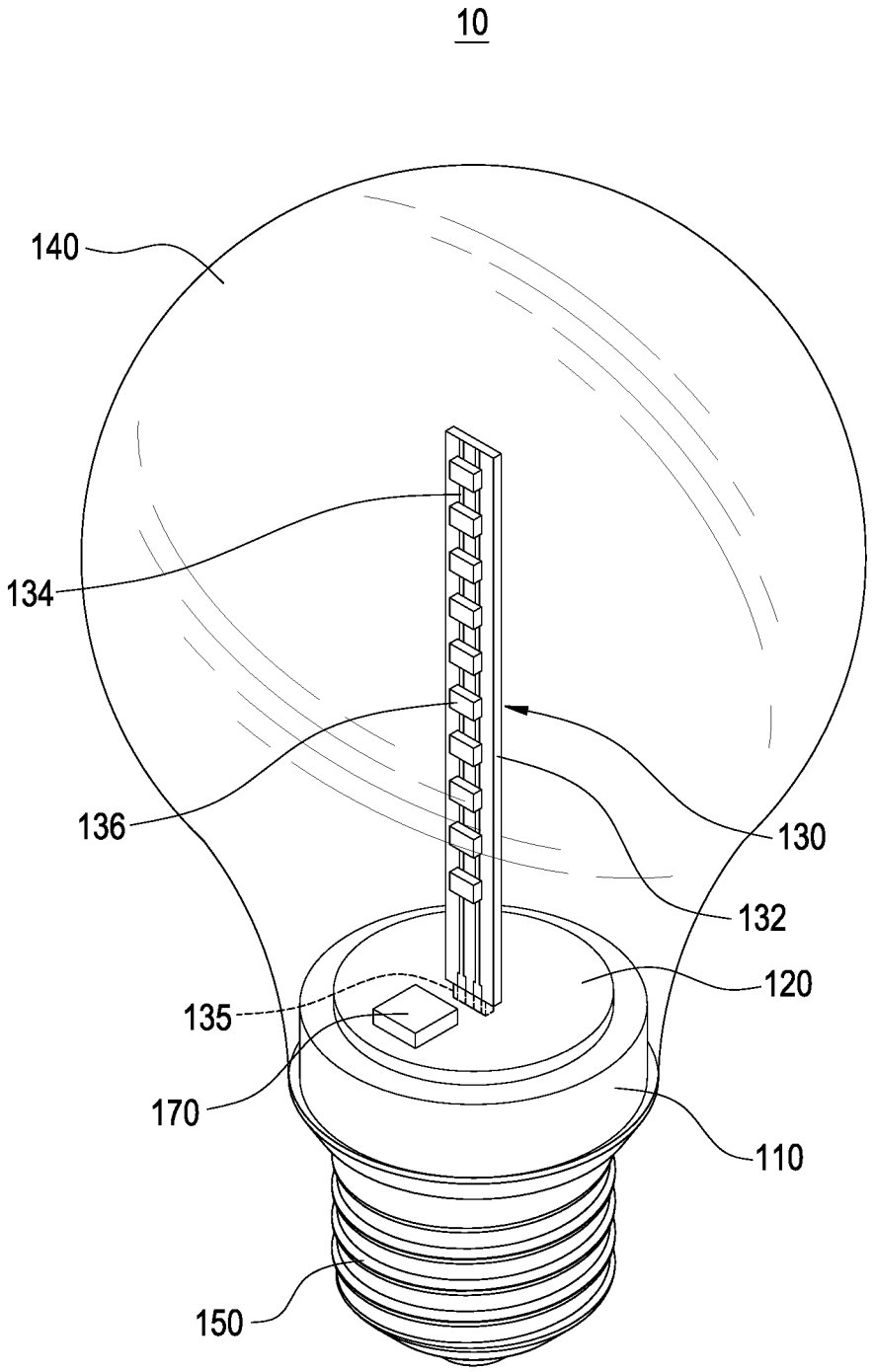
FIG. 2 is a perspective view of an LED bulb according to a first embodiment of the present invention.
Figure 3:
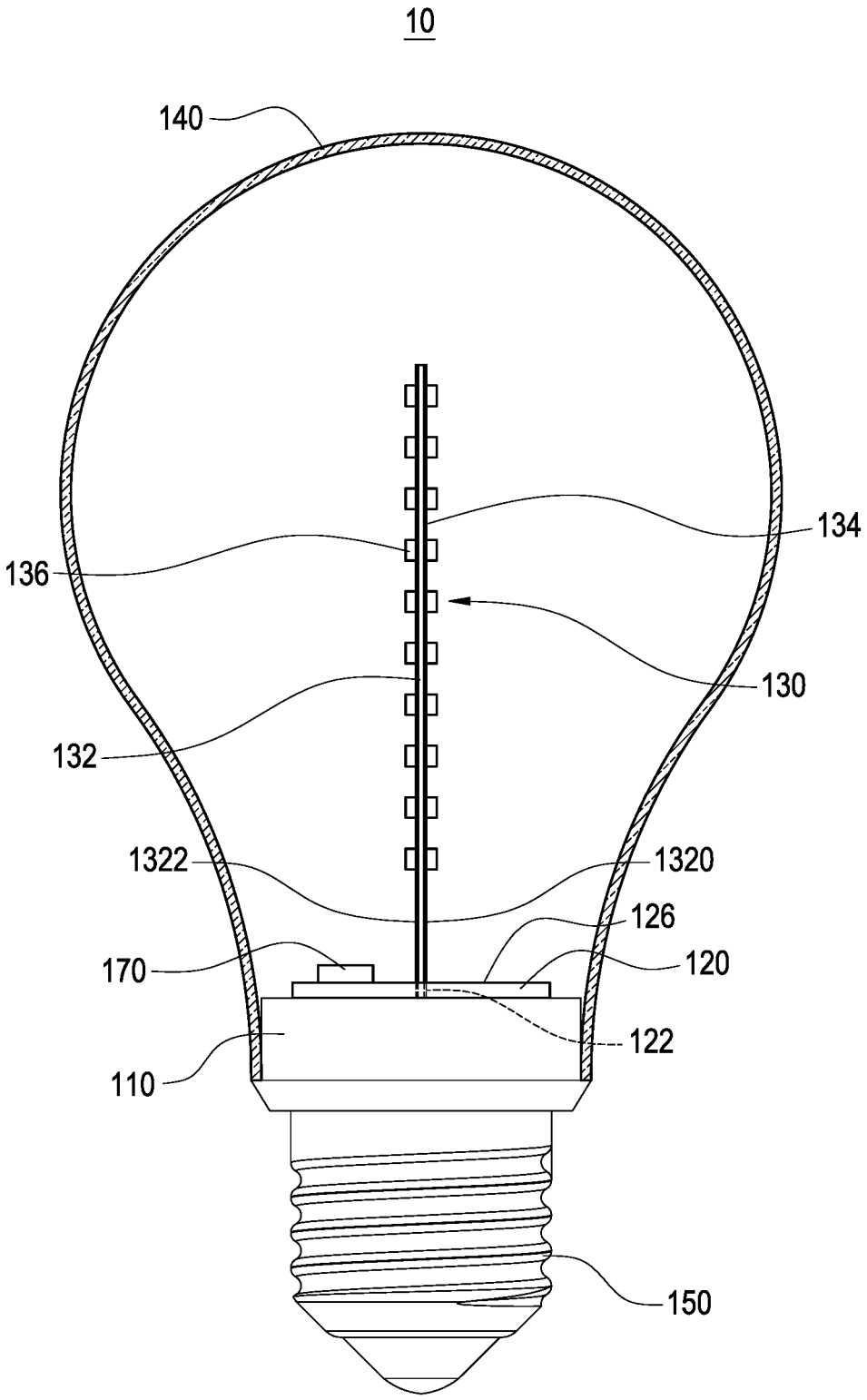
FIG. 3 is a sectional view of the LED bulb according to the first embodiment of the present invention.

Referred is made to FIG. 2 and FIG. 3, which are respectively a perspective view and sectional view of a light emitting diode (LED) bulb according to a first embodiment of the present invention, The LED bulb 10 is used for providing a light source with a particularly illuminate intensity similar to that of incandescent. The LED bulb 10 includes a lamp holder 110, a circuit board 120, at least one lighting module 130, a lamp shade 140, and a conductive connector 150.

The lamp holder 110 is, for example, made of plastic or ceramic. In this embodiment, the lamp holder 110 is of cylinder shape. However, the profile of the lamp holder 110 mentioned above is used for demonstration and is not limitation of the claim scope of the present invention. The lamp holder 110 is used for supporting the circuit board 120 and the lighting module 130.

The circuit board 120 is arranged on one side of the lamp holder 110. In this embodiment, the circuit board 120 is FR-4 glass fiber circuit board with characteristics of high mechanical strength, nonflammable, and moisture-proof However, in the practical application, the circuit board 120 can be metal core printed circuit board (PCB) or other printed circuit board, Moreover, the circuit board 120 is circular, and a surface area of the circuit board 120 is smaller than a surface area of a surface of the housing 110 contacted with circuit board 120. The circuit board 120 includes at least a slot 122, the slot 122 is a slot structure penetrating through the circuit board 120. A driver 170 for driving the lighting module 130 to emit light is placed on the circuit board 120. The driver 170 is electrically connected to the circuit board. 170.

The lighting module 130 includes a transmissive substrate 132, a circuit layer 134, an electrode component 135, and a plurality of LED dies 136. The transmissive substrate 132 is a glass substrate, and a transmittance of the transmissive substrate 132 is larger than 50%. In particularly, the transmittance is a ratio between an illuminant intensity of light passing through the transmissive substrate 132 and an illuminant intensity of light entering the transmissive substrate 132. The material of the transmissive substrate 132 can be. selected from a group including Aluminum oxide, Gallium nitride (GaN), glass, Gallium phosphide (GaP), Silicon carbide (SiC), and chemical vapor deposition (CVD) diamond. The transmissive substrate 132 includes a first surface 1320 and a second surface 1322 opposite to the first surface 1320. In this embodiment, the transmissive substrate 132 is rectangular, and the first surface 1320 and the second surface 1322 are two surfaces having larger area. However, in the practical application, the profile of the transmissive substrate 132 can be adjusted to be other shape such as circular or polygon based on the different situations.

The circuit layer 134 is attached to at least one of the first surface 1320 and the second surface 1322 of the transmissive substrate 132. The circuit layer 134 is made of material having characteristic of electrically conductive (such as copper) and used for electric power conductive path. In this embodiment, the circuit layer 134 is simultaneously attached to the first surface 1320 and the second surface 1322 with strip-shape, and a length of the circuit layer 134 attached on the first surface 1320 is the same as a length of the circuit layer 134 attached on the second surface 1322.

The electrode component 135 is arranged on one end of the transmissive substrate 132 and electrically connected to the circuit layer 134. In this embodiment, the electrode component 135 is arranged on a widthwise side of the transmissive substrate 132 and electrically connected to the circuit layer 134. The electrode component 135 is inserted into the slot 122 such that the transmissive substrate 132 stands on the circuit board 120, the first surface 1320 and the second surface 1322 is perpendicular to a plane 126 of the circuit board 120, and the circuit board 120 is electrically connected to the light module 130. In particularly, solder (not shown) can be placed between the electrode component 135 and the slot 122 for fastening the electrode component 135 on the circuit board 120 such that combing strength and electrically conduction between the electrode component 135 and the circuit board 120 can be effectively increased.

The LED dies 136 are placed on at least one of first surface 1320 and the second surface 1322 of the transmissive substrate 132, respectively, and electrically connected to the circuit layer 132. The LED dies 136 can be electrically connected in series, in parallel or in series-parallel connection via the circuit layer 134. In this embodiment, the LED dies 136 are placed on the first surface 1320 and the second surface 1322, respectively. The amount of the LED dies 136 placed on the first surface 1320 is the same as the amount of the LED dies 136 placed on the second surface 1322, and the arrangement of the LED dies 136 placed on the first surface 1320 is the same as the arrangement of the LED dies 136 placed on the second surface 1322, namely the LED dies 136 placed on the first surface 1320 and the LED dies 136 placed on the second surface 1322 are arranged in the same manner. The LED dies 136 are placed on the transmissive substrate 132 by die attachment, and then electrically connected to the circuit layer 134. The LED dies 136 can be flip chip LED dies for directly attaching to the circuit layer 134, however, the LED dies 136 can also be horizontal or vertical structure LED dies for electrically connecting to the circuit layer 134 via at least one metallic wire. In the present invention, light emitted from the LED dies 136 cannot be shielded or absorbed by the transmissive substrate 132 during to the transmittance of the transmissive substrate 132 is larger than 50%, therefore the light-use efficiency of the LED bulb 10 can be effectively enhanced.

The conductive connector 150 is arranged on the other side of the circuit board 120 and assembled with the lamp shade 140 such that the circuit board 120 and the lighting module 130 are respectively arranged between the conductive connector 150 and the lamp shade 140. The lamp shade 140 can be selected to be transparent or semi-transparent to modulate illuminant intensity of light emitting from the lamp shade 140. Moreover, the lamp shade 140 can also modulate lighting characteristic (converge light or diverge light) of light passing therethrough, therefore the optical characteristic of the LED bulb 10 can fit practical demand. The conductive connector 150 is used for connecting to a lamp socket for receiving an electric power to light the LED dies 136. A plurality of power wires (not shown) can be arranged between the conductive connector 150 and the circuit board 120 to electrically connect the conductive connector 150 and the circuit board 120. The power wires penetrate the housing 110. The power wires is used for transmitting the electric power to the circuit board 120, and the electric power transmits to the lighting module 130 via the electrode component 135 to light the LED dies 136.

Figure 4:
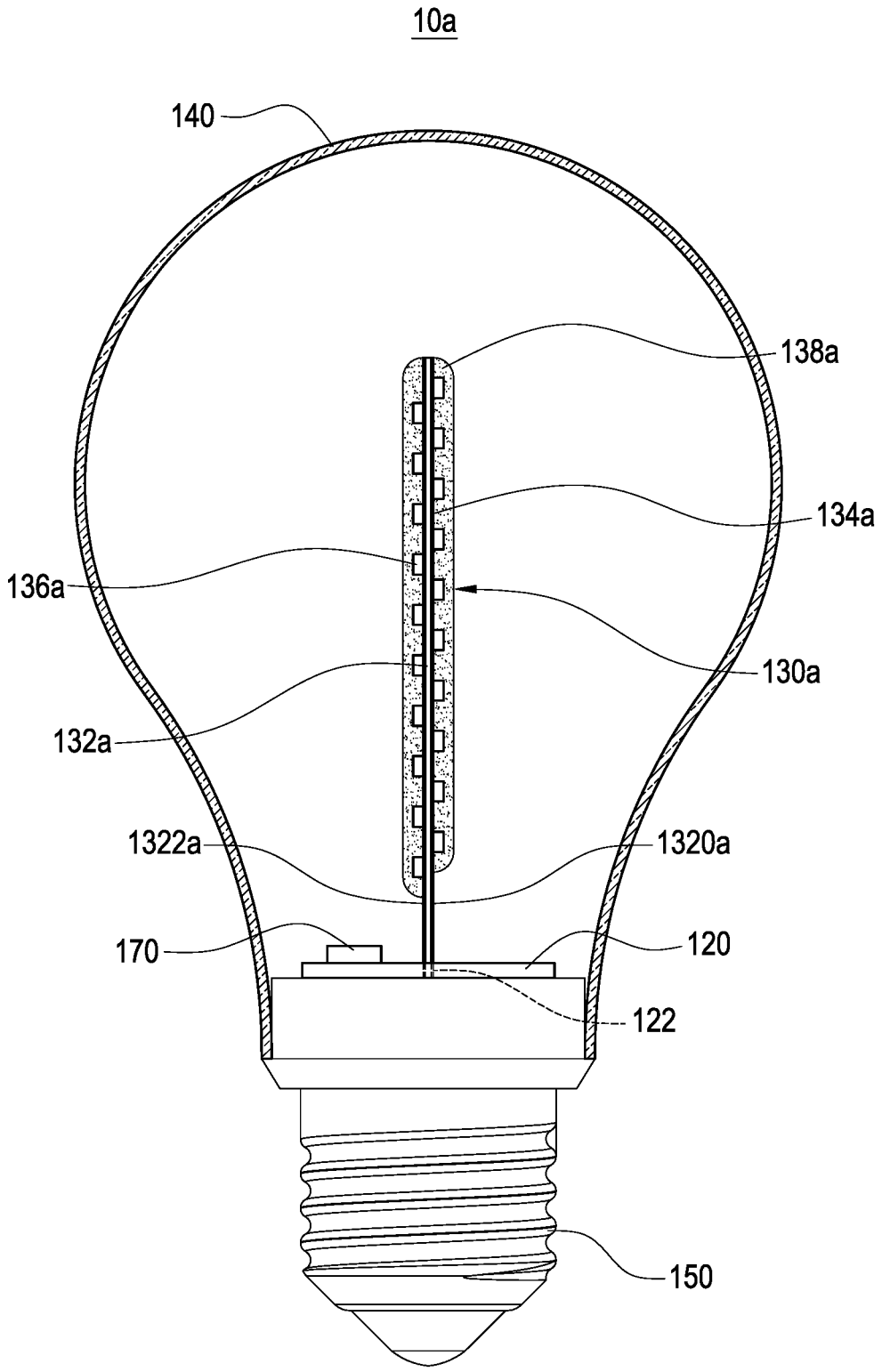
FIG. 4 is a sectional view of an LED bulb according to a second embodiment of the present invention.

Referred is made to FIG. 4, which is a sectional view of a LED bulb according to a second embodiment of the present invention. The LED bulb 10*a*. is similar to the LED bulb 10 mentioned in the first embodiment, and the same reference numbers are used in the drawings and the description to refer to the same parts. It should be noted that a lighting module 130*a* shown in the FIG. 4 is different from the lighting module 150 shown in FIG. 3.

The lighting module 130*a* includes a transmissive substrate 132*a*, a circuit layer 134*a*, a plurality of LED dies 136*a*, and a phosphor layer 138*a*. The circuit layer 134*a* is attached to a first surface 1320*a* and a second surface 1322*a* opposite to the first surface 1320*a* of the transmissive substrate 132*a*.

The LED dies 136*a* are placed on the first surface 1320*a* and the second surface 1322*a*, respectively, and electrically connected to the circuit layer 134*a*. The LED dies 136*a* placed on the first surface 1320*a* and the LED dies 136*a* placed on the second surface 1322*a* are arranged in a staggered manner.

The phosphor layer 138*a* including a plurality of phosphors covers the LED dies 136*a*. The phosphor layer 138*a* is excited by partial light emitted from the LED dies 136*a* and then converts the light into a wavelength-converted light, which is to be mixed with the other light emitted from the LED dies 136*a* to generate a light with demand color. In this embodiment, the phosphor layer 138*a* simultaneously covers the LED dies 136*a* placed on the first surface 1320*a* and the second surface 1322*a*, which is convenient to be manufacture, However, the phosphor layer 138*a* can cover at least one of the LED dies 136*a*. The function and relative description of other components f the LED bulb 10*a* are the same as that of first embodiment mentioned above and are not repeated here for brevity, and the LED bulb 10*a* can achieve the functions as the LED bulb 10 does.

Figure 5:
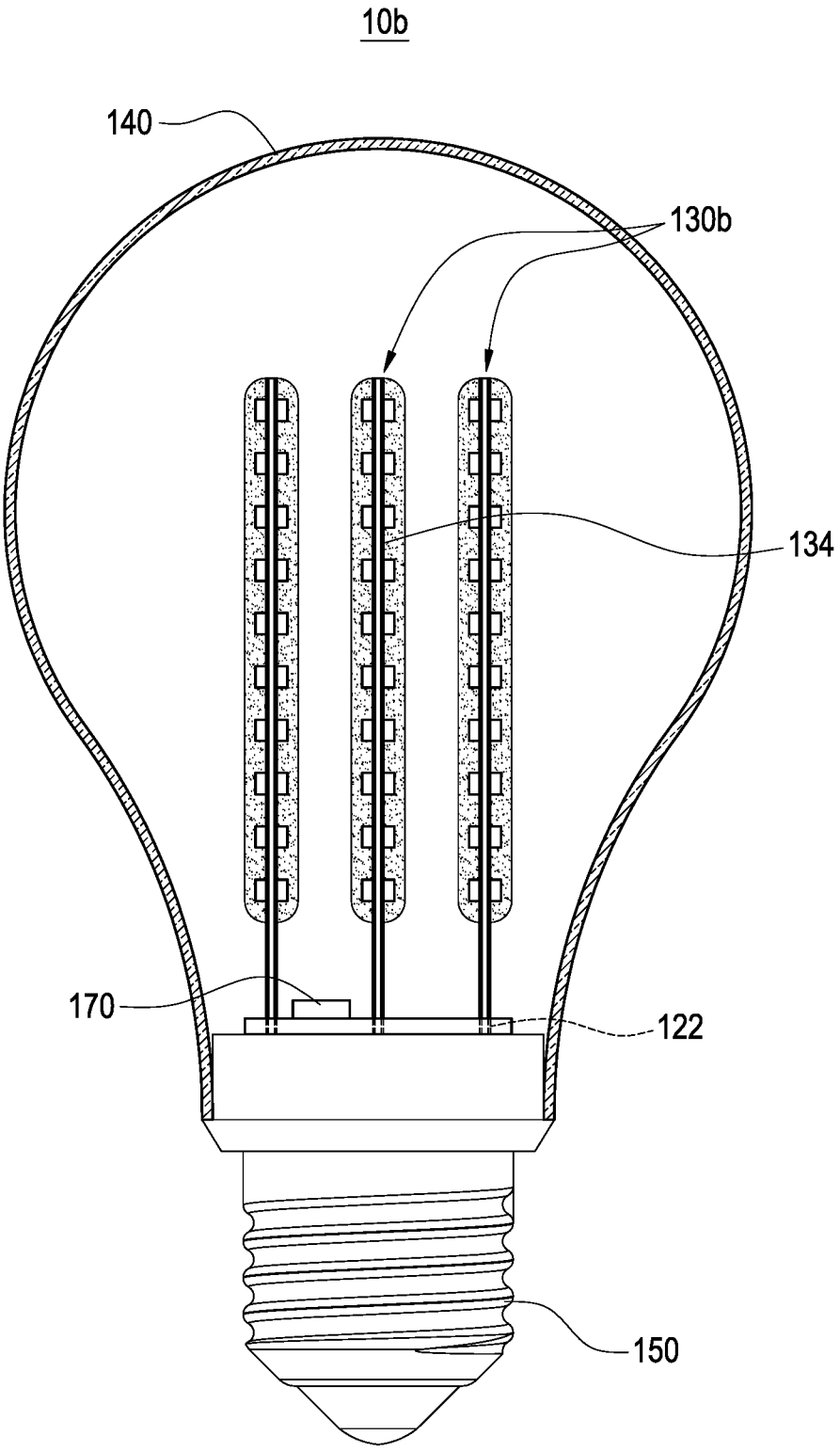
FIG. 5 is a sectional view of an LED bulb according to a third embodiment of the present invention.

Referred is made to FIG. 5, which is a sectional view of a LED bulb according to a third embodiment of the present invention. The LED bulb 10*b* is similar to the LED bulb 10*b* mentioned in the second embodiment, and the same reference numbers are used in the drawings and the description to refer to the same parts. It should be noted that the LED bulb 10*b* includes a plurality of lighting modules 130*b* arranged in linear manner.

The lighting modules 130*b* are respectively inserted into a plurality of slots 122 formed on the circuit board 120 to receiving an electric power for lighting the LED bulb 10*b*.

A distance between two adjacent lighting modules 130*b* is a constant, therefore luminance of the LED bulb 10*b* can be effectively enhanced and a light source with uniform illuminant intensity can be provided. However, in the practical application, the arrangement (such as irregular) of the lighting modules 130*b* can be modulated by demand illuminant intensity. The function and relative description of other components of the LED bulb 10*b* are the same as that of first embodiment mentioned above and are not repeated here for brevity, and the LED bulb 10*b* can achieve the functions as the LED bulb 10*a* does.

Although the present invention has been described with reference to the foregoing preferred embodiment, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. An LED bulb comprising:

a circuit board comprising a first slot and a second slot;

a first lighting module comprising:

a first substrate comprising a first surface having a first end portion, a second surface opposite to the first surface, and a side surface connecting the first surface and the second surface;

a circuit layer arranged on the first surface;

a first electrode component connected to the first end portion, and comprising a first top surface coplanar with the first surface, wherein the circuit layer extends to the first top surface;

a plurality of first LED dies arranged on the first surface and electrically connected to the circuit layer and the electrode component; and a phosphor layer continuously contacting the plurality of first LED dies without covering the first electrode component and the side surface;

a second lighting module comprising:

a second substrate physically separated from the first substrate and comprising a third surface;

a plurality of second LED dies arranged on the third surface; and a second electrode component comprising a second top surface coplanar with the third surface and inserted into the second slot;

an electrical connector electrically connected to the circuit board; and a lamp shade associated with the electrical connector, wherein the first electrode component is inserted into the first slot, and has a width different from the circuit layer.

2. The LED bulb in claim 1, wherein the first substrate has a first axis and a second axis shorter than the first axis.

3. The LED bulb in claim 2, wherein the circuit layer has a strip-shape substantially extending along the first axis.

4. The LED bulb in claim 1, wherein the circuit layer comprises a circuit portion arranged on the second surface.

5. The LED bulb in claim 1, wherein the plurality of first LED dies comprises a first group of LED dies, and the first lighting module comprises a second group of LED dies placed on the second surface, the first group of LED dies and the second group of LED dies have a same arrangement.

6. The LED bulb in claim 1, wherein the first lighting module comprises a plurality of another LED dies placed on the second surface, and another phosphor layer covering the plurality of another LED dies.

7. The LED bulb in claim 1, wherein the first surface has a length substantially equal to that of the circuit layer.

8. The LED bulb in claim 1, wherein the first surface of the first substrate has a second end portion opposite to the first end portion, and the phosphor layer is distant from the first end portion than the second end portion.

9. The LED bulb in claim 1, wherein the plurality of first LED dies comprises a first group LED dies, the first lighting module comprises a second group LED dies placed on the second surface, and the first group LED dies and the second group LED dies are arranged in a staggered configuration.

10. The LED bulb in claim 1, wherein the first end portion is invisible when the first lighting module stands in the lamp shade.

11. The LED bulb in claim 1, wherein the first substrate is substantially perpendicular to the circuit board.

12. The LED bulb in claim 1, further comprising a second phosphor layer covering the second surface.

13. The LED bulb in claim 1, wherein the width of the first electrode component is smaller than that of the circuit layer.

* * * * *